United States Patent [19]

Freeberg

[11] Patent Number: 4,781,316

[45] Date of Patent: Nov. 1, 1988

[54] PAPER TOWEL CUTTER

[76] Inventor: John C. Freeberg, P.O. Box 1131, Rancho Sante Fe, Calif. 92140

[21] Appl. No.: 913,956

[22] Filed: Oct. 1, 1986

[51] Int. Cl.[4] ..... A47K 10/36; B26D 1/02

[52] U.S. Cl. ..... 225/71; 225/91

[58] Field of Search ..... 225/71, 67, 91, 69, 225/56, 73

[56] References Cited

U.S. PATENT DOCUMENTS

| | | | |
|---|---|---|---|
| Re. 11,042 | 11/1889 | Drosten | 225/71 |
| 398,762 | 2/1889 | Winheim | 225/71 X |
| 481,839 | 8/1982 | Beach et al. | 225/71 X |
| 823,120 | 6/1906 | Helmeke | 225/91 |
| 1,217,147 | 2/1917 | Burwell | 225/71 |
| 1,330,005 | 2/1920 | Ranney | 225/69 X |
| 2,229,961 | 1/1941 | Deane | 225/91 |
| 2,331,791 | 10/1943 | Noel | 225/91 |
| 2,572,245 | 10/1951 | Coldiron | 225/91 |
| 2,592,865 | 4/1952 | Corey | 225/91 |
| 2,731,084 | 1/1956 | Burns | 225/71 X |
| 2,878,980 | 3/1959 | Waltz | 225/91 |
| 3,144,185 | 8/1964 | Shirejian | 225/91 |
| 3,173,591 | 3/1965 | Sax et al. | 225/91 |
| 3,693,853 | 9/1972 | Siegal | 225/71 X |
| 4,307,829 | 12/1981 | Stoveken | 225/67 |

*Primary Examiner*—Frank T. Yost

*Attorney, Agent, or Firm*—Brown, Martin, Haller & Meador

[57] ABSTRACT

A paper cutting apparatus for tearing off a sheet of paper of any desired length from a paper roll. The apparatus includes a cutter comprising an elongated, arcuate-shaped plate, which is detachable placed over the paper roll and between the sides of a paper roll holder. The plate includes a notch at each side edge to loosely engage the sides of the holder and a serrated cutting edge along its front edge.

5 Claims, 1 Drawing Sheet

PAPER TOWEL CUTTER

BACKGROUND OF THE INVENTION

The present invention relates to a paper cutting apparatus, and more particularly to a paper towel cutter used in combination with a conventional roll holder to facilitate the cutting of paper of any desired length.

A variety of cutters having a cutting edge that is placed on a roll of paper, tape or like material, and held thereupon during the severing operation is well known in the art. For example, U.S. Pat. No. 2,572,245 of Coldiron shows a cutter that is manually held on a roll for tear-off action, but the method of holding would not be practical on an elongated roll of towels.

U.S. Pat. No. 3,173,591 of Sax et al discloses a cutter which clips on an elongated roll, but does not seem capable of handling a substantial variation in thickness of the rolled material.

U.S. Pat. No. 823,120 of Helmeke teaches a roll holder with an attached tear-off bar which is spring-biased against the roll.

Other patents show various types of attachments and holders with tear-off edges. None of the prior art, however, teaches the specific structure of the instant invention.

SUMMARY OF THE INVENTION

It is an object of the present invention to provide a new and improved apparatus to conveniently tear off a sheet of paper of any desired length from a roll of paper placed in a roll holder.

It is another object of this invention to provide a new and improved, durable and long-lasting paper towel cutter which can be easily manufactured.

It is a further object of this invention to provide a new and improved, inexpensive paper towel cutter which can be detachably mounted onto a paper roll holder.

A paper towel cutter, according to a preferred embodiment of the instant invention, comprises an elongated, arcuate-shaped plate, that is loosely engaged by its notched ends to the sides of a conventional paper roll holder. The plate includes a cutting edge composed of a series of serrated sections extending along its front edge.

Conventional paper towel cutters utilized in noncommercial applications do not have a serrated edge or other cutting means to sever sections of paper of various lengths. Usually, a roll of paper is placed on a holder so that it can rotate freely. A sheet of paper is then torn off by a user only where the sheets are perforated.

The paper roll holder may include a flat edge to facilitate tearing of paper sheets at the perforations, but such means is inadequate for sheets having lengths between the perforations because the paper is torn unevenly. Thus, in many applications around the house, paper is wasted because the paper towels used are larger than required. For example, only a small sheet of paper would be required to wipe up the water marks left by a coffee mug on a table.

The claimed paper towel cutter prevents waste and alleviates aggravation when jagged sections of paper are severed by conveniently providing a way in which the user can cleanly tear off sheets of any desired length.

BRIEF DESCRIPTION OF THE DRAWINGS

The objects and many advantages of the instant paper towel cutter will become more clear upon a reading of the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
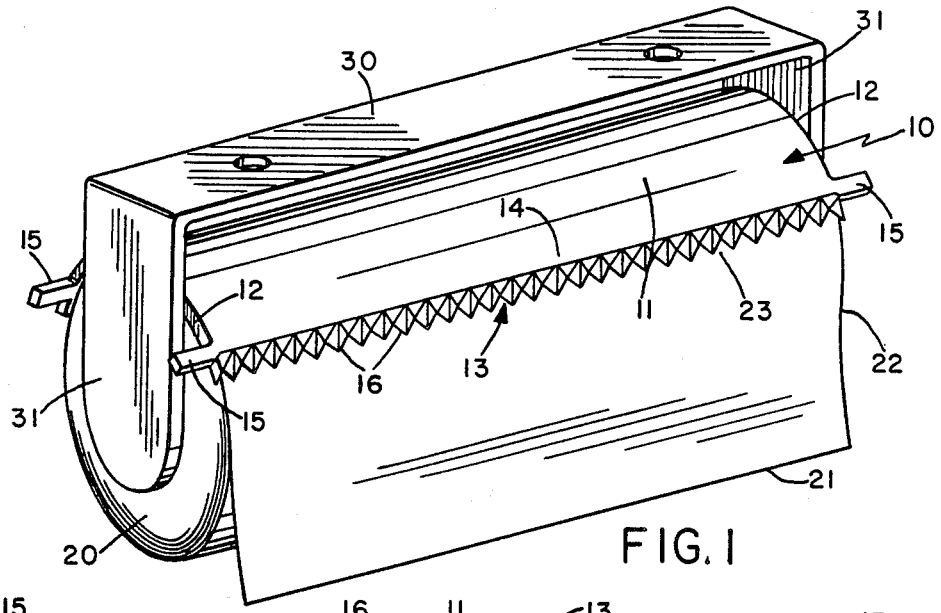
FIG. 1 is a perspective view of one embodiment of a paper towel cutter, shown in combination with a holder and a roll of paper.
Figure 2:
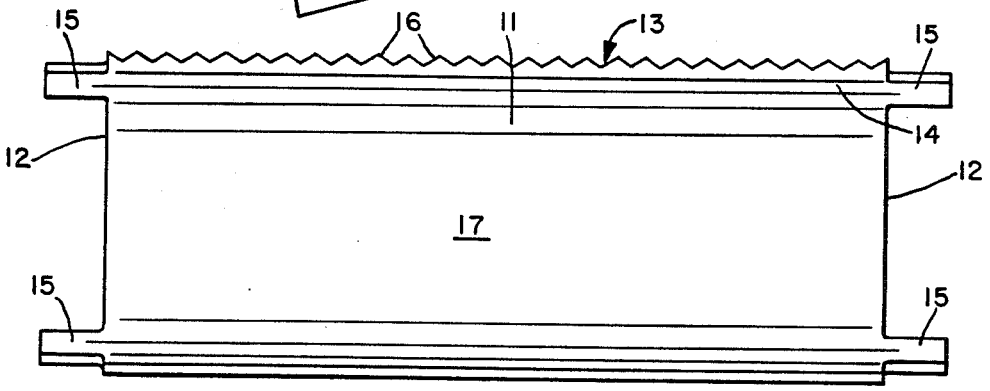
FIG. 2 is a bottom view of the paper towel cutter.

FIGS. 1–4 illustrate a paper towel cutter according to a preferred embodiment of the invention. The cutter 10 basically consists of an elongated, arcuate-shaped plate 11 whose length is about the same as that of a roll of paper 20 provided in a roll holder 30.

The plate 11 includes integrally formed notches 12 placed at each side of the cutter 10 to loosely receive the sides 31 of holder 30, and a cutting edge 13 extends along the front edge 14 of the apparatus. The notches 12 define a projection 15 at each corner of plate 11. These projections 15 are designed to keep the cutter positioned above the paper roll 20 and loosely engaged between sides 31 of holder 30.

Figure 3:
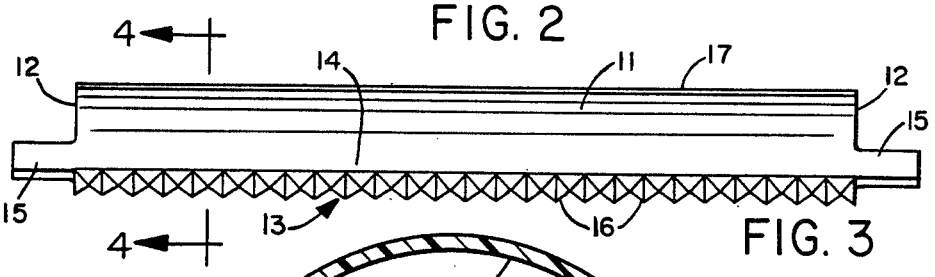
FIG. 3 is a front elevation view of the paper towel cutter showing the projections at each corner of the plate and the serrated edge substantially along its front edge.
Figure 4:
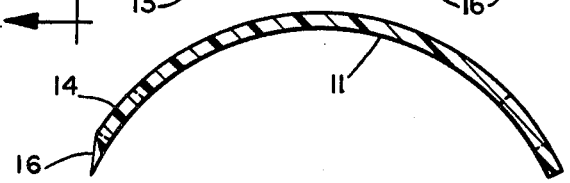
FIG. 4 is a detailed sectional view of the paper towel cutter taken along line 4—4 of FIG. 3.

As best seen in FIGS. 1, 3 and 4, paper towel cutter 10 is an arcuate-shaped plate 11, whose radius is dimensioned to fit the size of paper roll 20 used. In most applications, the cutter has a radius of $2\frac{1}{4}$ inches and fits conventional-sized paper rolls found in most homes. In such circumstances, the length of cutting edge 13 is about $10\frac{7}{8}$ inches and the overall length of the cutting apparatus, including projections 15, is about $12\frac{7}{8}$ inches.

Cutting edge 13 is comprised of a series of serrated sections 16, which extend along the front edge 14 of cutter 10. Like projections 15, the serrated sections 16 are integrally formed along with the arcuate-shaped plate 11. The serrated sections 16 are designed to be easily manufactured, while providing an adequate and safe cutting edge.

In a typical operation, the claimed paper towel cutter 10 is disposed above a paper roll 20, which is placed in a roll holder 30. When a section of paper is needed, the user conveniently finds the leading edge 21 of paper roll 20 below the cutter's cutting edge 13. Thus, the user simply lifts up the detachably-mounted cutter 10 and holds the paper 20 at its leading edge 21 or its side edge 22. The user then rotates paper roll 20 and a paper section of desired length is provided. The user then momentarily presses his other hand firmly against plate 11 so that the trailing edge 23 of the paper can be cut along the cutters cutting edge 13. The user completes this operation by pulling the paper towel 20 upwardly, whereupon the desired length of paper is evenly and cleanly severed from paper roll 20. Even in circumstances where the user tears off a sheet of paper using only one hand (the other hand not being placed on the cutter), projections 15 will properly engage the cutter 10 between sides 31 of roll holder 30. Thus, the user's jerking motion when tearing off the paper will not cause the cutter 10 to fall off its holder 30.

Although the claimed apparatus can be manufactured from any suitable material, plastic is utilized in the preferred embodiment. Preferably, the various parts of the cutter are integrally formed in one simple manufacturing process. By this process, attendant cost savings are realized as compared to manufacture of the cutter by assembling individual parts.

The cutter is sturdy and durable. Typically, the cutter is designed to be about 3/16 inch thick and the plate's arcuate surface defines a sector, as shown in FIG. 4 of approximately 130 degrees. Stiffening ribs (not shown) can be optionally provided to maintain flatness of upper surface 17 of plate 11. The material utilized should also be non-reactive to kitchen solvents to make the cutter durable and long-lasting.

Although a preferred embodiment of the invention has been described by way of example, it will be understood by those skilled in the field that modifications may be made to the disclosed embodiment which are within the scope of the invention as defined by the appended claims.

What is claimed is:

1. A detachedly engaged paper cutting apparatus in combination with a paper roll holder for cutting paper and the like having substantial variation in thickness to any desired length comprising:

an elongated, arcuate-shaped plate disposed between said holder and a roll of paper, said plate having a longitudinal axis substantially identical to that of the paper roll and said plate comprising, a notch positioned at opposite ends of the plate to receive sides of the paper roll holder, said notch defining a projection at each corner of said plate to loosely engage the apparatus between the paper roll and sides of the holder, said projections being coplanar with each other; and an integrally-formed cutting edge at the front edge of the plate extending substantially along its entire length.

2. The paper cutting apparatus of claim 1 wherein said cutting edge further comprises a series of serrated sections.

3. The paper cutting apparatus of claim 1 wherein said apparatus is constructed of non-reactive material to prevent corrosion by solvents.

4. The paper cutting apparatus of claim 1 wherein said apparatus is constructed of plastic material suitable for injection molding.

5. The paper cutting apparatus of claim 1 wherein said plate is substantially semi-cylindrical in shape.

* * * * *

UNITED STATES PATENT AND TRADEMARK OFFICE

CERTIFICATE OF CORRECTION

PATENT NO. : 4,781,316

DATED : November 1, 1988

INVENTOR(S) : John G. Freeberg

It is certified that error appears in the above-identified patent and that said Letters Patent is hereby corrected as shown below:

Title page, item [76] the applicant's name appears as "John C. Freeberg" but should be --John G. Freeberg--.

The applicant's address appears as "Rancho Sante Fe, California 92140" but should be --Rancho Santa Fe, California 92067--.

Signed and Sealed this

Thirty-first Day of July, 1990

*Attest:*

HARRY F. MANBECK, JR.

*Attesting Officer*

*Commissioner of Patents and Trademarks*